US008435052B2

(12) United States Patent
Potters

(10) Patent No.: US 8,435,052 B2
(45) Date of Patent: May 7, 2013

(54) CONNECTOR WITH A HOUSING PIVOTALLY SUPPORTING FLOATING TERMINALS

(75) Inventor: Paul Potters, Eindhoven (NL)

(73) Assignee: FCI, Guyancourt (FR)

( * ) Notice: Subject to any disclaimer, the term of this patent is extended or adjusted under 35 U.S.C. 154(b) by 0 days.

(21) Appl. No.: 12/998,454

(22) PCT Filed: Oct. 27, 2008

(86) PCT No.: PCT/IB2008/055367

§ 371 (c)(1),
(2), (4) Date: Apr. 20, 2011

(87) PCT Pub. No.: WO2010/049758

PCT Pub. Date: May 6, 2010

(65) Prior Publication Data

US 2011/0201222 A1 Aug. 18, 2011

(51) Int. Cl.
*H01R 12/00* (2006.01)

(52) U.S. Cl.
USPC ..... 439/80

(58) Field of Classification Search ..... 439/74, 439/79, 83, 60, 80
See application file for complete search history.

(56) References Cited

U.S. PATENT DOCUMENTS

| | | | | | |
|---|---|---|---|---|---|
| 4,968,263 | A | | 11/1990 | Silbernagel et al. | 439/246 |
| 5,040,999 | A | * | 8/1991 | Collier | 439/108 |
| 5,127,839 | A | * | 7/1992 | Korsunsky et al. | 439/79 |
| 5,199,885 | A | * | 4/1993 | Korsunsky et al. | 439/79 |
| 5,496,180 | A | * | 3/1996 | Fabian et al. | 439/60 |
| 5,588,878 | A | * | 12/1996 | Flinchbaugh et al. | 439/682 |
| 5,788,515 | A | * | 8/1998 | Mitra et al. | 439/83 |
| 5,876,217 | A | * | 3/1999 | Ito et al. | 439/74 |
| 5,885,092 | A | * | 3/1999 | Ito et al. | 439/74 |
| 5,931,689 | A | * | 8/1999 | Patel | 439/346 |
| 2001/0049213 | A1 | * | 12/2001 | Potters et al. | 439/80 |

FOREIGN PATENT DOCUMENTS

| | | |
|---|---|---|
| EP | 1 102 357 A1 | 5/2001 |
| FR | 2 318 519 | 2/1997 |
| NL | 9 401 537 | 5/1996 |

* cited by examiner

*Primary Examiner* — Chandrika Prasad
(74) *Attorney, Agent, or Firm* — Harrington & Smith

(57) ABSTRACT

The invention is directed to a connector including an insulating housing with a plurality of channels accommodating at least one right-angle electro-conductive terminal leading from a mating side of the connector to a surface mount side of the connector. At least a part of channels is provided with a support surface which is adapted to pivotably support the terminal, the support surface being located at a distance above a bottom surface of these channel.

17 Claims, 9 Drawing Sheets

CONNECTOR WITH A HOUSING PIVOTALLY SUPPORTING FLOATING TERMINALS

FIELD OF THE INVENTION

The invention relates to a connector, comprising an insulating housing with a plurality of channels accommodating electro-conductive terminals leading from a mating side to a surface mount, for a surface mount connection to a contact pad of a circuit board.

BACKGROUND OF THE INVENTION

Connectors for mounting to circuit boards or the like are provided with contact leads or terminals that engage contact pads on the surface of the circuit board. After positioning and securing the connector with respect to the circuit board, the terminals are usually soldered to the circuit board. To obtain a reliable soldered contact between the terminal leads and the circuitry of the circuit board, it is important that the terminals of the connector are coplanar and within the proximity of the solder pads on the surface of the circuit board. If the terminals are not coplanar to each other within a small range, typically about 0.10 mm, the lowest positioned terminals will sit on the top surface of the contact pad where they will be securely soldered, while the highest positioned terminals will be so far from the contact pads that they will not become securely soldered.

To prevent coplanarity problems, it has been proposed in EP 1 102 357 to have terminals pivotably floating within corresponding channels, in such a way that each terminal end pivots down under its own weight. When the connector is positioned for soldering, the terminal ends all rest on the corresponding contact pads on the circuit board, while a good contact is obtained under the weight of the pivoting terminals. The connector in EP 1 102 357 is particularly suitable when the terminal end does not require to be expandable in a resilient way, for instance to receive a pin of a mating connector.

SUMMARY OF THE INVENTION

It is an object of the invention to provide a connector with improved surface mount solderability without requiring very accurate coplanarity of the contact terminal ends for a broad range of surface mount connector types.

The object of the invention is achieved with a connector according to claim 1.

As a result, when the connector is positioned for being mounted to a circuit board, the connection elements rest on the contact pads by their own weight and/or with a reaction force. As a result, all terminals rest on the corresponding contact pads or solder pastes on the printed circuit board, enabling secure soldering. Unevenness of the printed circuit board is also compensated.

The contact mating end comprise two opposite resilient fingers for resiliently engaging a pin of a mating connector. One of the resilient fingers may then be pivotably supported by the support surface in the channel. If the two resilient fingers are above each other, the upper resilient finger can, e.g., be pivotably supported by the support surface, so the lower resilient finger may be flexed downwardly when a connector pin is inserted between the two resilient fingers. Due to the fact that the pivot point is at a distance above the bottom of the channel, both fingers have full freedom to flex away from each other when a connector pin is inserted. After insertion of a contact pin between the resilient fingers of the floating terminal, the contact forces are equally divided over the two resilient fingers, regardless of the exact position of the inserted pins.

In one embodiment of such a connector, the tip of at least one of the resilient fingers comprises one or more stubs resting on a support surface. The supported resilient finger can for example have two stubs symmetrically arranged resting on two opposite support surfaces at either side of the resilient finger, in order to obtain a balanced support.

In an alternative embodiment, the two opposite resilient fingers may clamp around the support, which may for instance be a pre-load rail. Such a pre-load rail may for example be used to push the resilient fingers apart to allow easier insertion of a contact pin of a mating connector. The resilient fingers may have bent tips. These bent tips are arranged in such a way that the contact point between the upper finger and the support is at a distance closer to the mating side of the connector than the contact point between the lower finger and the support. This creates a moment resulting in a reaction force pushing the surface mount end downwards, which results in a better contact with the circuit board when the connector is positioned for soldering. The distance between the two contact points may be dimensioned such that the created moment is in balance with the connectors own weight in order to prevent that the surface mount ends lift the connector.

To limit the moveability of the terminal in its longitudinal direction, the terminal may be provided with one or more projections, such as a tab. A tab may stop the terminal from moving backward when a mating contact pin is inserted, without blocking the floating. The terminal may also have a stop preventing the terminal from moving too far into the direction of the mating side when a pin of a mating connector is taken out of the connector.

The terminals have a first leg with the connection end under an angle with a second leg comprising the terminal end. The first and second legs are substantially under right angles with each other.

Optionally, a weight block can be used to provide additional weight to the surface mount end of the connection element. This results in an extra force pushing the contact ends downwardly. If one of the terminals keeps hanging on a projecting irregularity, such as a burr, the full weight of the block rests on the burr, so the weight of the block may push the terminal past the burr. Moreover, the weight of the block or blocks may shift the center of gravity and stabilize the position of the connector.

BRIEF DESCRIPTION OF THE DRAWINGS

The present invention will be understood with reference to the figures wherein.

DETAILED DESCRIPTION OF EMBODIMENTS

Figure 1:
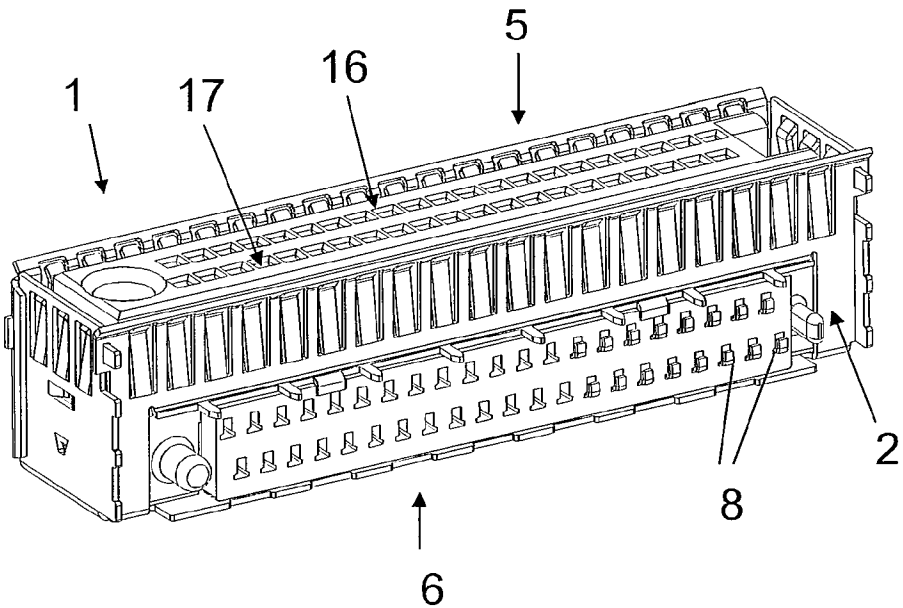
FIG. 1: shows in perspective view a connector according to the invention.

FIG. 1 shows an example of surface mount connector 1 according to the present invention. The connector 1 comprises an insulating housing 2 with a plurality of electro-conductive terminals 4 leading from a mating side 5 of the connector 1 to a surface mount side 6 of the connector 1. In use, the surface mount connector 1 is connected to a printed circuit board by soldering the terminals 4 on the contact pads of the circuit board. At its mating side 5, a mating connector can be coupled to the connector 1.

As can be seen in FIG. 1, openings 9 are arranged in two staggered rows 16, 17 corresponding to a staggered, space-saving arrangement of the terminals 4 within the connector 1. In an alternative embodiment, the terminals can be arranged in a non-staggered configuration, e.g., right above one another, or in any other suitable arrangement.

Figure 2:
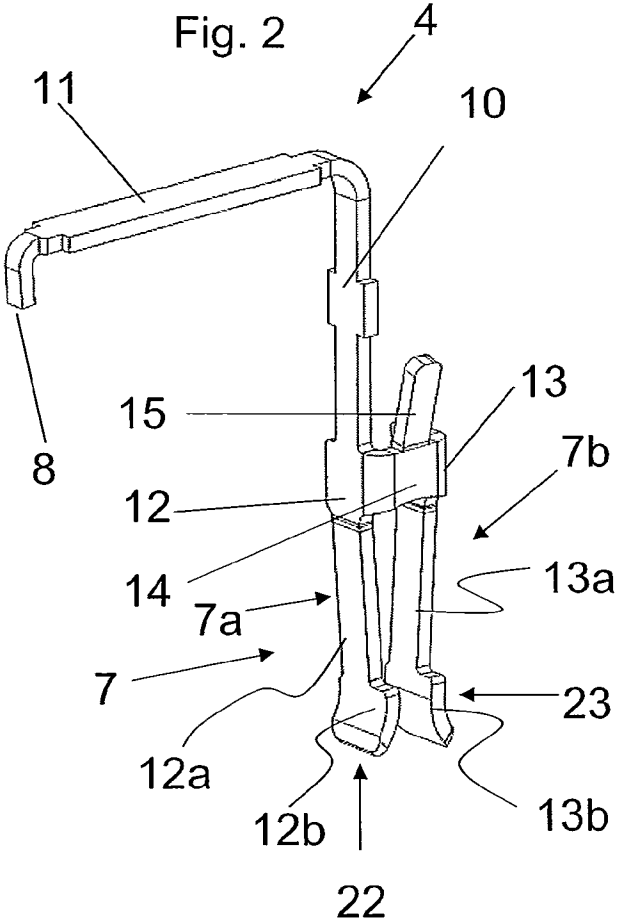
FIG. 2: shows in perspective view a terminal of the connector of FIG. 1.

FIG. 2 shows in perspective view a terminal or contact lead 4 as encased in the connector 1 of FIG. 1. The terminal 4 comprises a connection end or connection mating portion 7 and a bent surface mount end 8. The connection mating portion 7 is accessible from the mating side 5 of the connector 1 via the openings 9. The bent surface mount end 8 projects from the surface mount side 6 of the connector 1. The connection mating portion 7 is part of a first leg 10 of the terminal 4 which is under right angles with a second leg 11 comprising the surface mount end 8. The connection mating portion 7 comprises an upper resilient finger 7*a* and a lower resilient finger 7*b* linked by a bridging section 14 at a distance closer to the second leg 11 of the terminal 4.

The resilient fingers 7*a*, 7*b* comprise, respectively:

- a first portion 12, 13 connected to the bridging section 14; and
- a second cantilevered arm 12*a*, 13*a* extending from the first portion 12, 13.

The second cantilevered arms 12*a*, 13*a* are further bent inwardly with respect to the first portion 12, 13 so that they converge towards each other. The second cantilevered arms 12*a*, 13*a* comprise a tip 22,23 having inwardly facing opposed contact end. Each tip 22, 23 is curved in order to enable easier insertion of a pin. Each tip 22, 23 is formed with a lateral wing (or extension) 12*b* and 13*b* the purpose of which will be explained below.

It should be noted that the total length of the upper resilient finger 7*a* is longer than that one of the lower resilient finger 7*b*. Such an arrangement is advantageous for improving downward pivoting movement of the terminal due to gravity force exerted on the terminal.

When a mating connector is mated with the connector 1, pins of the mating connector are introduced into the openings 9 in the connector 1 and are clamped between the two resilient fingers 12, 13. The bridging section 14 is provided with a tab 15 the function of which will be described below.

Figure 3:
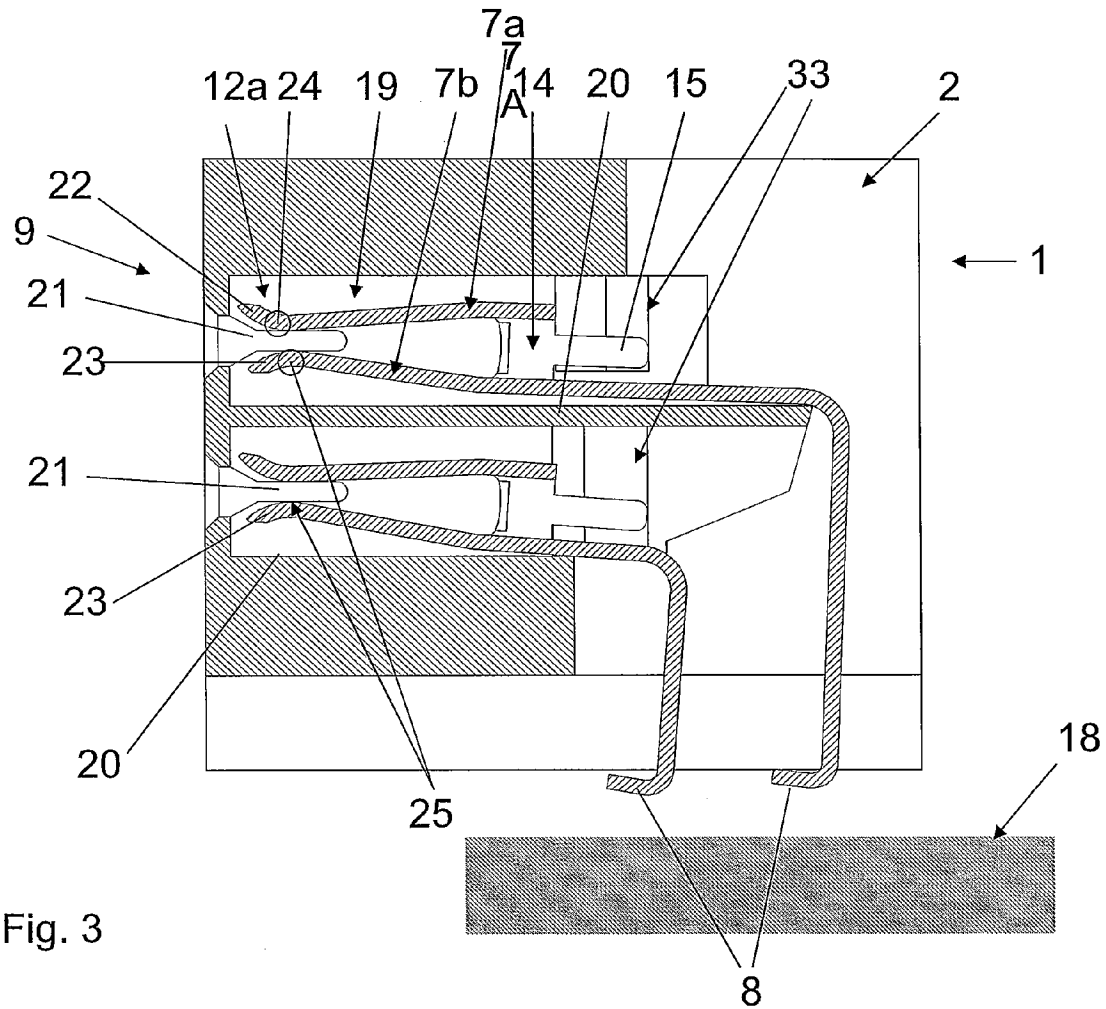
FIG. 3: shows in cross section the connector of FIG. 1 before being mounted on a circuit board.

FIG. 3 shows a cross section of the connector 1 of FIG. 1 in a plane perpendicular to the longitudinal direction of the connector 1. For reasons of clarity, the cross section of FIG. 3 represents the terminals 4 as if they were in line above one another. In FIG. 3, the connector 1 is not yet mounted and is held at a distance above a printed circuit board 18.

Figure 5:
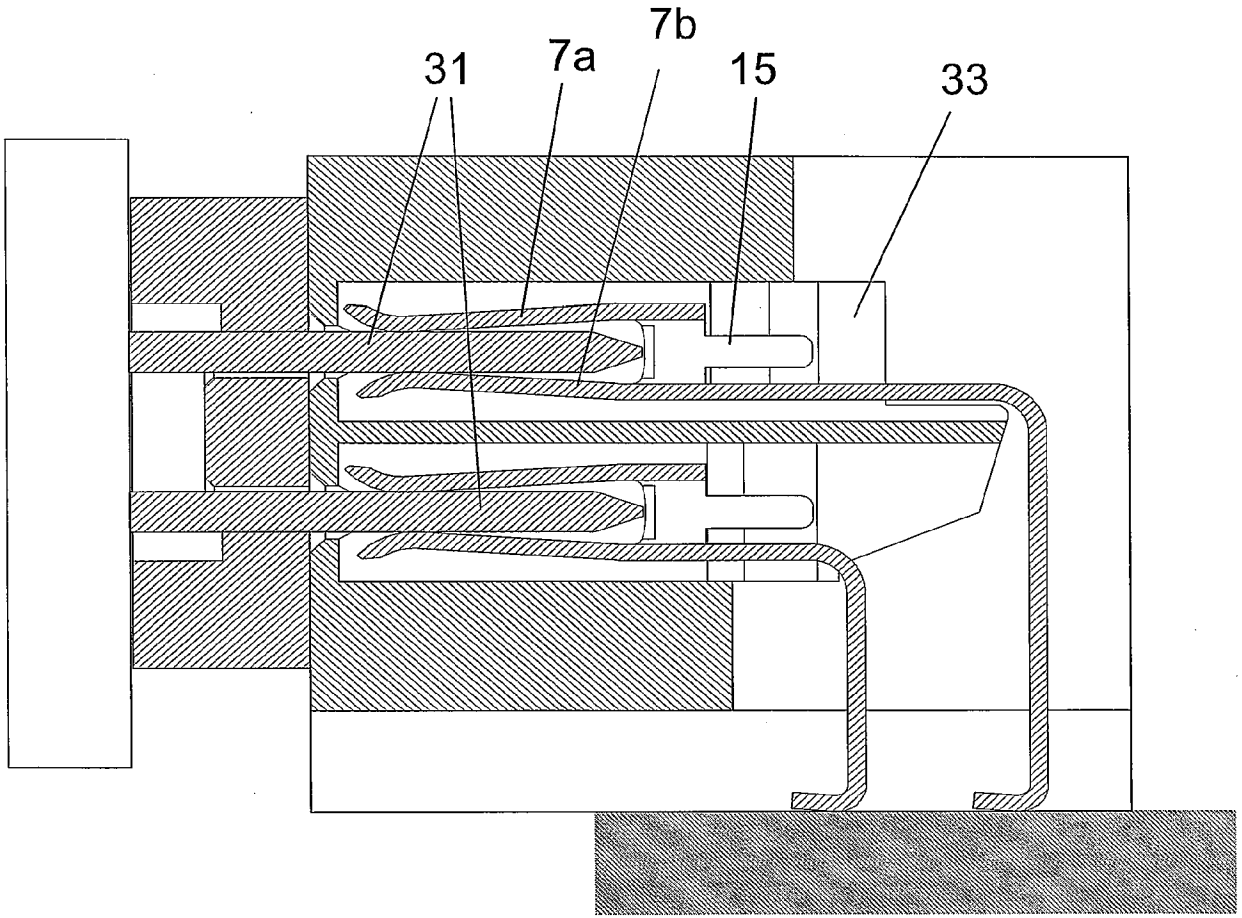
FIG. 5: shows in cross section the connector of FIG. 1 mounted on a circuit board after connection with a mating connector.

The terminals 4 are accommodated in channels 19 leading to the openings 9. The channels 19 have a bottom surface 20. Pre-load rails 21 are arranged in the channels 19 at either side of each opening 9 at a distance above the bottom surface 20. The pre-load rails 21 are positioned only between the side edges of the connection ends 7, leaving a free space between the resilient fingers 7*a*, 7*b* for entrance of a pin from a mating connector, as is shown in FIG. 5. The pre-load rails 21 push the resilient fingers 7*a*, 7*b* away from each other. This way, the fingers of all contacts are equally spaced so variation in required force to insert a contact pin, resulting from deflection variations is effectively reduced. The lateral wing 12*b* of the upper resilient finger 7*a* has a contact point 24 with the pre-load rail 21, which is at a distance closer to the opening 9 than the contact point 25 between the pre-load rail 21 and the lateral wing 13*b* of the lower resilient finger 7*b*. This creates a moment resulting in a force pushing the surface mount end 8 downwards, enforcing the moment caused by gravity. This way the pre-load rail 21 forms a support surface pivotably supporting the mating portion 7 of the terminal 4.

Figure 4:
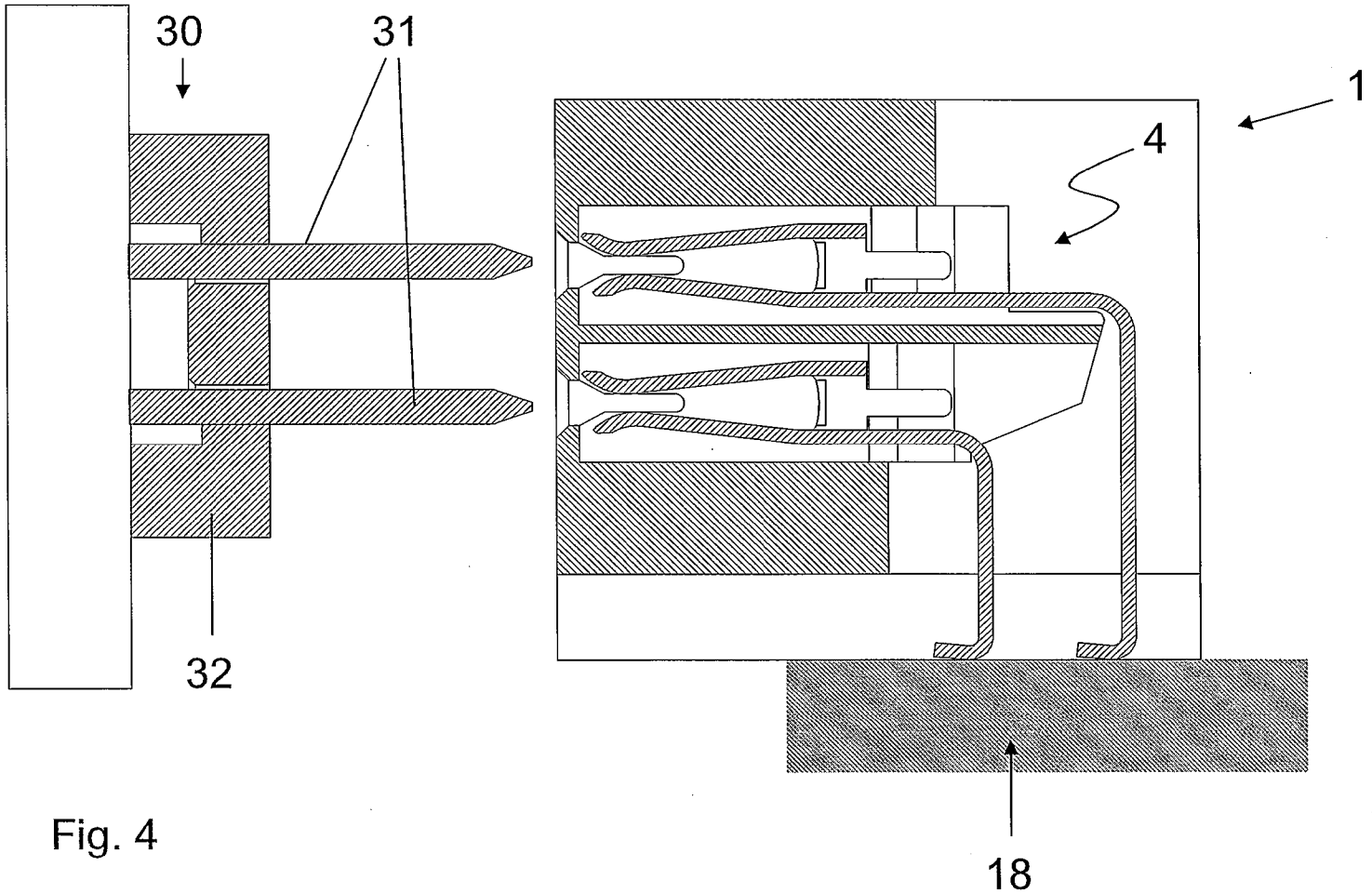
FIG. 4: shows in cross section the connector of FIG. 1 mounted on a circuit board.

FIG. 4 shows the connector 1 in the same cross section as shown in FIG. 3, after the connector 1 has been mounted on the printed circuit board 18. While the housing 2 rests on the circuit board 18, the surface mount ends 8 of the terminals 4 are lifted. Due to the rotational moment caused by the weight of the terminals 4 and by the reaction forces at the contact points 24, 25, all surface mount ends 8 are gently pressed onto corresponding contact pads (not shown) on the circuit board 18. There are no deficient contacts caused by coplanarity deviancies. Any unevenness of the circuit board 18 is also compensated by the gentle downward pressure on the surface mount ends 8.

FIG. 4 also shows a compatible pin connector 30 to be mated with the connector 1. The pin connector 30 comprises connector pins 31 projecting from an insulating housing 32, which can be inserted in openings 9 and between the tips 22, 23, as shown in FIG. 5. The pins 31 press the resilient fingers 7*a*, 7*b* away from each other, disengaging them from the pre-load rail 21.

In reference with FIG. 5, while inserting a pin 31 into an opening between two resilient fingers 7*a*, 7*b*, the exerted force pushes the terminal 4 backwards. To stop a backward movement of the terminal 4, the channel 19 is provided with an internal stop 33 engaging the tab 15 when the terminal 4 moves backward.

Figure 6:
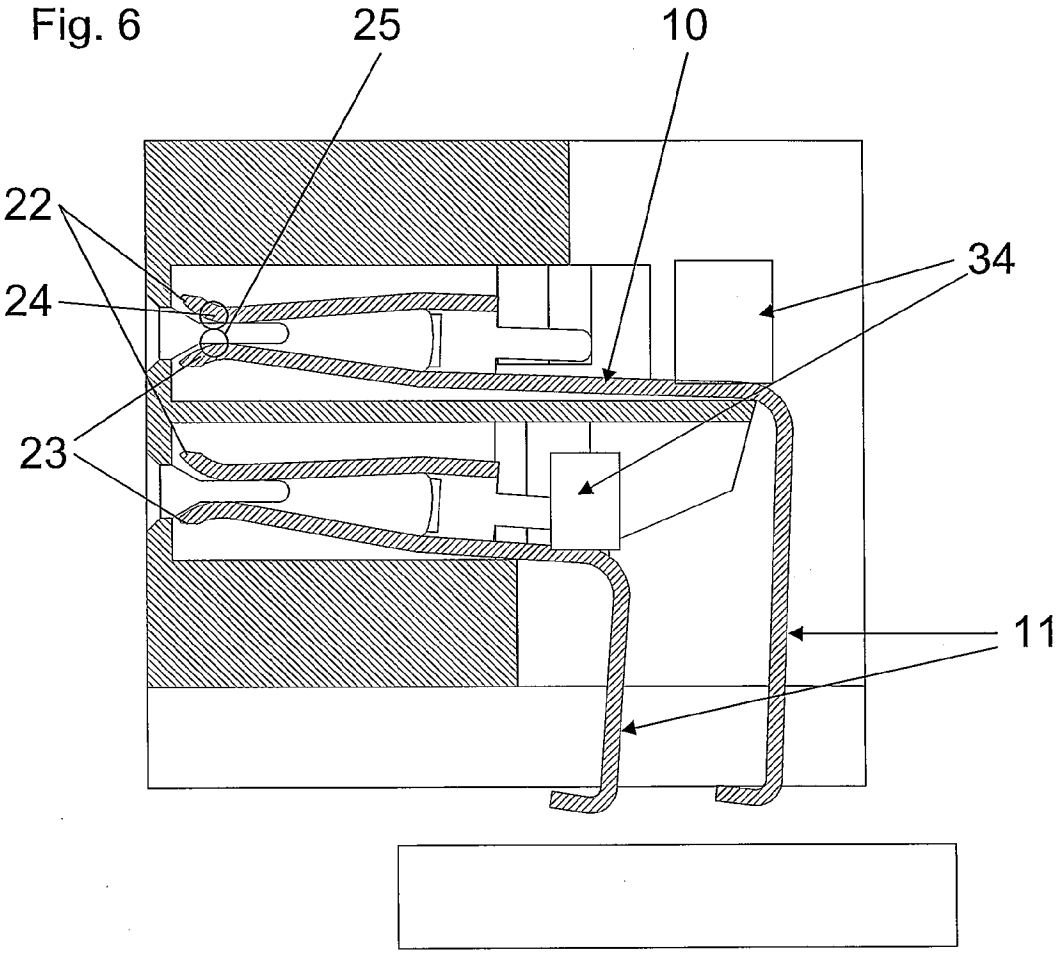
FIG. 6: shows in cross section an alternative embodiment of a connector according to the invention before mounting on a circuit board.

In an alternative embodiment, shown in FIG. 6, the contact points 24, 25 between the pre-load rail 21 and the tips 22, 23 are arranged right above each other. In that case, the force pushing down the contact ends 8 is gravitational. To increase this gravitational force, additional weights 34, for instance a plastic block, can be positioned on the first sections of the terminals close to the second leg 11.

Figure 7:
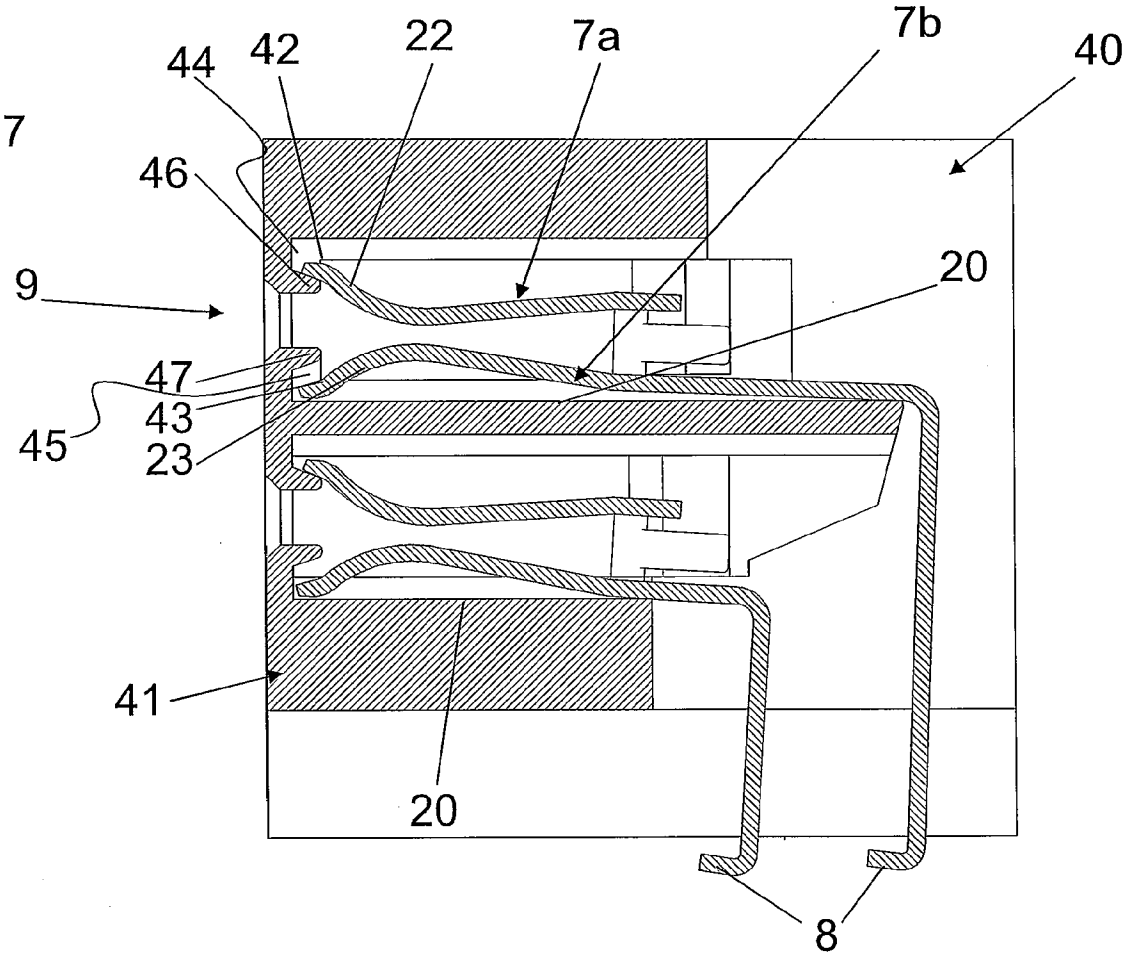
FIG. 7: shows in cross section a third embodiment of a connector according to the invention before being mounted on a circuit board.

FIG. 7 shows an alternative embodiment of a connector 40 according to the present invention. In the drawing, same referential numbers are used for parts that are the same as with the connector shown in FIGS. 1-5.

The connector 40 comprises a housing 41 of an insulating material. In the connector 40, the tips 22, 23 are respectively extended with positioning stubs 42, 43, positioned in an upper slot 44 and lower slot 45 respectively. The slots 44, 45 extend in a direction parallel to the longitudinal direction of the resilient fingers 7*a*, 7*b*. The positioning stubs 42, 43 and the slots 44, 45 may be of a smaller width than the main part of the resilient fingers 7*a*, 7*b*. Inside the housing 41 of the connector 40, the openings 9 are provided with an inwardly projecting upper rim 46 and a lower rim 47. The upper rim serves as a support surface for the upper positioning stub 42. When the connector 40 is positioned on a printed circuit board, the surface mount ends 8 are lifted and the upper rim 46 with the positioning stub 42 forms a pivot point.

Figure 8:
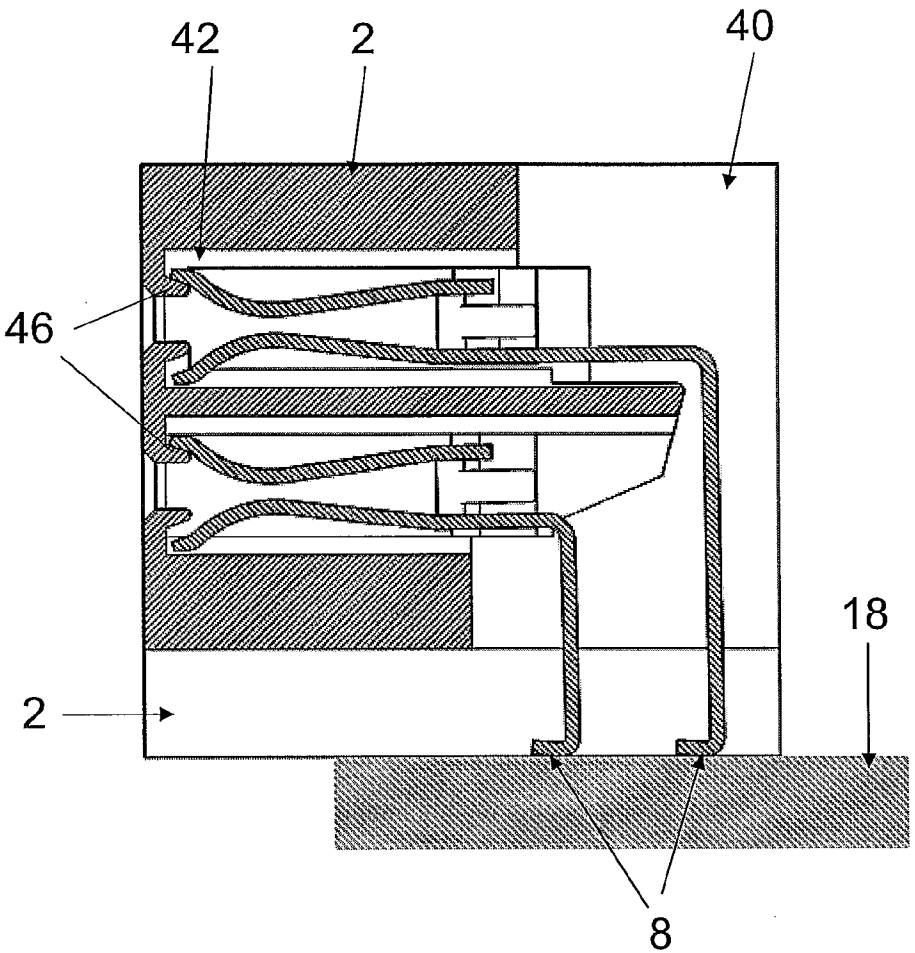
FIG. 8: shows in cross section the connector of FIG. 7 mounted on a circuit board.

FIG. 8 shows the connector 40 mounted on a circuit board 18. The contact ends 8 are lifted to the level of the bottom surface of the housing 2. Positioning stub 42 rests on the upper rim 46.

Figure 9:
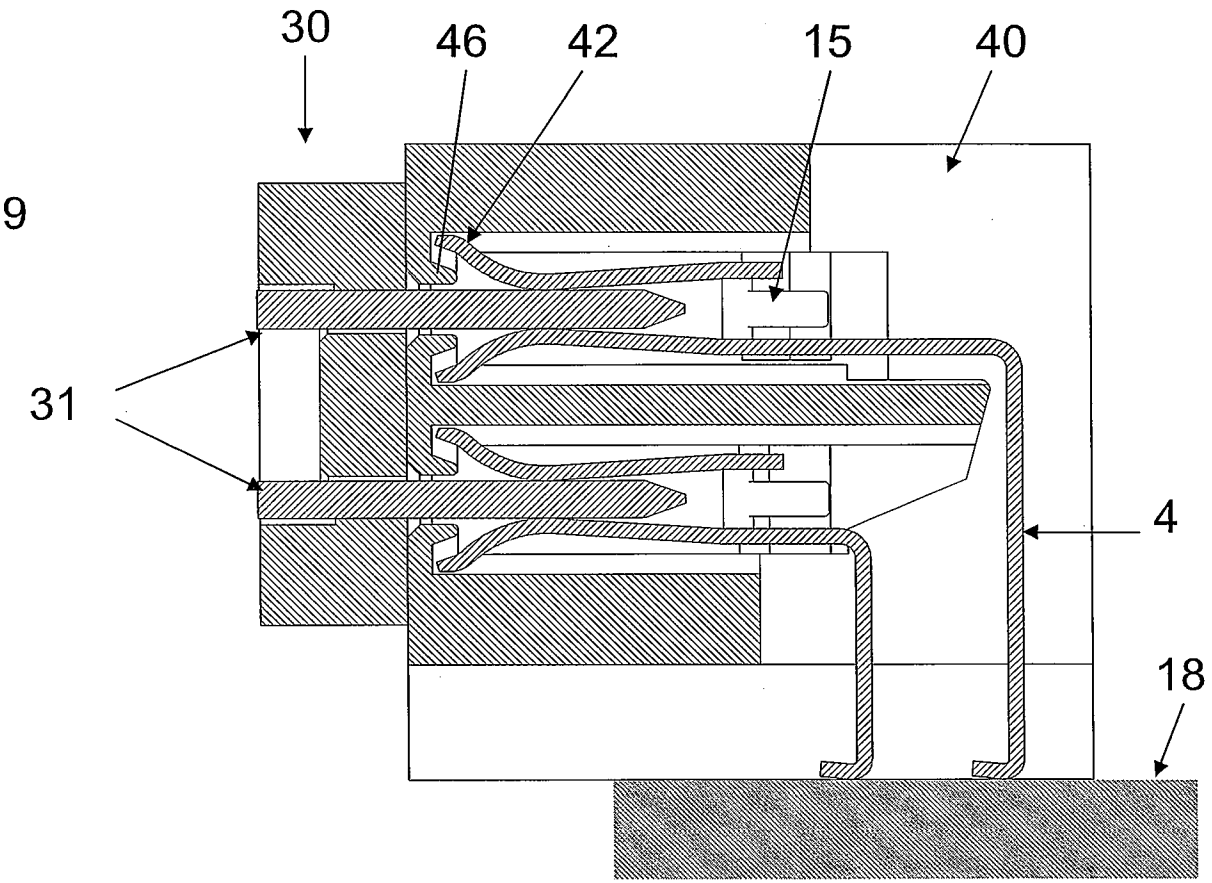
FIG. 9: shows in cross section the connector of FIG. 7 mounted on a circuit board after connection with a mating connector.

In FIG. 9, a pin connector 30 with pins 31 is mated to the connector 40. Pins 31 are inserted in the openings 9 between resilient fingers 7*a*, 7*b*. The upper positing stubs 42 do not rest anymore on the upper rims 46.

Figure 10:
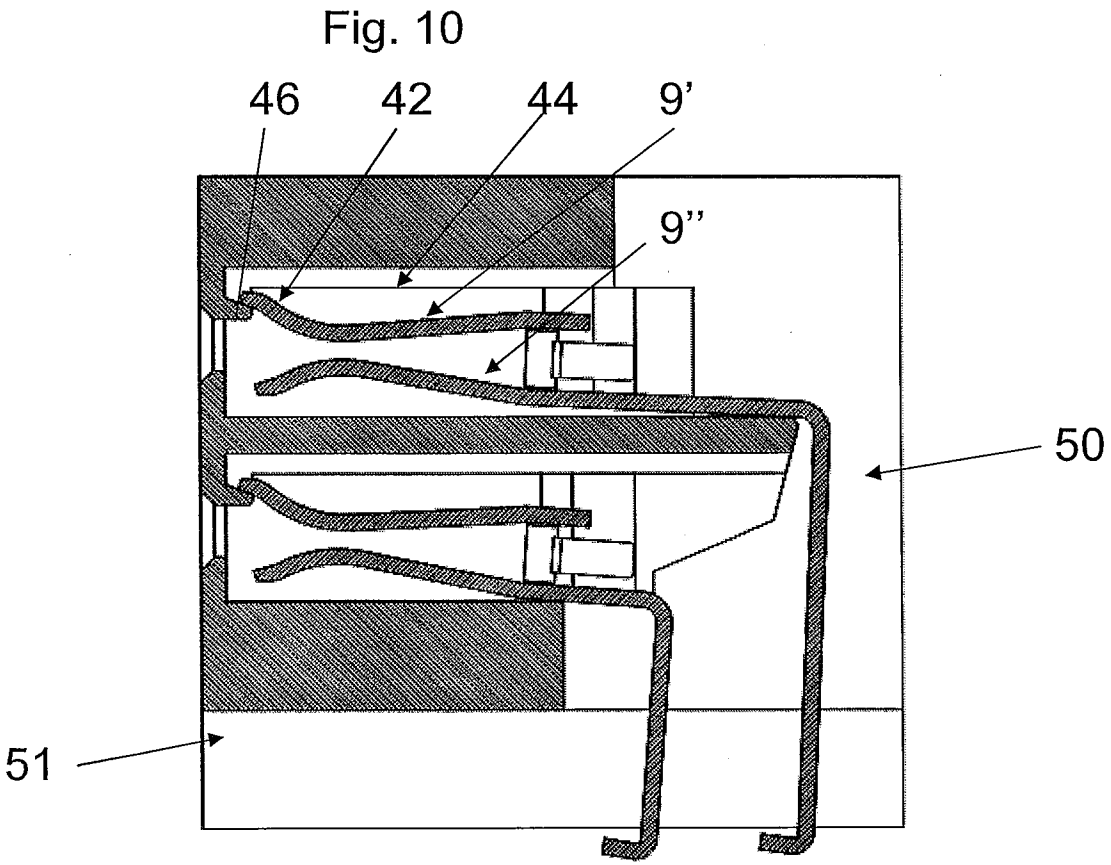
FIG. 10: shows in cross section a fourth embodiment of a connector according to the present invention.

FIG. 10 shows a fourth possible embodiment of a connector 50 according to the present invention, which is for most parts the same as the embodiment shown in FIGS. 7, 8 and 9. Again, same referential numbers are used for parts that are the same as with the connector shown in FIG. 7.

The connector 50 comprises a housing 51 of an insulating material. In the connector 50, only the upper resilient finger 7*a* has an outer tip 22 extended with a positioning stub 42 positioned in an upper slot 44. The lower finger 7*b* is not extended with such a stub. An upper rim 46 serves as a support surface for the positioning stub 42. When the connector 50 is positioned on a printed circuit board, the surface mount ends 8 are lifted and the upper rim 46 forms a pivot point for the positioning stub 42. Due to the absence of a lower slot, a higher density of channels 19 can be obtained resulting in a more compact connector construction.

The invention claimed is:

1. A connector, comprising an insulating housing with a plurality of channels accommodating at least one right-angle electro-conductive terminal leading from a mating side of the connector to a surface mount side of the connector, wherein at least a part of each of the channels is provided with a support surface adapted to pivotably support the terminal, the support surface being located at a distance above a bottom surface of these channel, where the at least one terminal comprises a contact point pivotably located on the support surface for a majority of the terminal to rotatably pivot at the contact point on the support surface when the connector is being connected to another member.

2. The connector according to claim 1, wherein the terminal includes a connection mating end comprising two opposite resilient fingers for resiliently engaging a pin of a mating connector.

3. The connector according to claim 2, wherein at least one of the resilient fingers has a tip comprising a stub forming the contact point adapted to rest on the support surface.

4. The connector according to claim 3, wherein the channel comprises a slot for guiding the stub of the resilient finger.

5. The connector according to claim 2, wherein the two opposite resilient fingers of the terminal clamp around the support surface.

6. The connector according to claim 5, where the terminal comprises two of the contact points, and wherein the resilient fingers comprise an upper finger and a lower finger and have tips with lateral wing arranged in such a way that a first one of the contact points between the upper finger and the support is closer to the mating side of the connector then a second one of the contact points between the lower finger and the support.

7. The connector according to claim 1, wherein the terminal is provided with a retention means limiting the movability of the terminal along its longitudinal direction.

8. The connector according to claim 1, further comprising a weight block adapted to provide additional downward pushing force to the surface mount end of the connection element.

9. A connector, comprising an insulating housing with a plurality of channels accommodating electro-conductive terminals leading from a mating side of the connector to a surface mount side of the connector, wherein the terminals comprise an upper resilient finger and a lower resilient finger for resiliently engaging a pin of a mating connector, wherein at least a part of the channels is provided with a support surface pivotably supporting the upper resilient finger, where a majority of the terminal is rotatable on the support surface at the upper resilient finger.

10. An electrical connector comprising:

a housing; and a plurality of electrical terminals connected to the housing, where the housing comprises a plurality of channels having the terminals located therein, where a connection of each of the terminals to the housing allows the terminals to move in'the channels to provide a substantially locational floating of the terminals in the channels, where the connection comprises a relative movement limiting system for limiting movement of the terminals in the channels, and where the relative movement limiting system comprises a contact point on a cantilevered portion of each of the terminals.

11. The electrical connector as claimed in claim 10 where the connection comprises a rotational pivot of the contact point on a surface in the channel, where the connection is configured such that a majority of the terminal pivots about the pivot point when the connector is connected to another member.

12. The electrical connector as claimed in claim 10 where the connector is a right angle connector, where the housing comprises entrances for mating electrical connector contacts at a first side, where the terminals comprise a connection end at a second side of the housing, and where the second side is generally orthogonal to the first side and configured to be mounted against another member.

13. The electrical connector as claimed in claim 10 where the housing comprises a preload rail in each of the channels, where the terminals each comprises opposing contact beams, where the contact beams are pre-loaded on the preload rails, and where a majority of each one of the terminals is pivotable on a respective one of the pre-loads.

14. The electrical connector as claimed in claim 10 where each of, the terminals comprises opposing contact beams, where the housing comprises a contact support proximate an entrance into each of the channels, where a tip of one of the contact beams of each terminal is pivotably located on one of the contact supports to allow a majority of each of the terminals to pivotably move in the channels at the tips on the contact supports.

15. The electrical connector as claimed in claim 10 where each electrical terminal comprises two opposing cantilevered deflectable beams adapted to mate with a mating male contact of another connector.

16. The electrical connecter as claimed in claim 15 where the contact point is on one of the beams.

17. The electrical connector as claimed in claim 10 where the contact points are pivotably located on a support surface in the channels for a majority of each of the terminals to rotatably pivot at the contact points on the support surface when the electrical connector is connected to another member.

* * * * *